United States Patent [19]

Simpson

[11] Patent Number: 4,991,511

[45] Date of Patent: Feb. 12, 1991

[54] NON-DISRUPTIVE DETONATING CORD

[75] Inventor: Geoffrey M. Simpson, Nottingham, England

[73] Assignee: Haley & Weller Limited, Derbyshire, England

[21] Appl. No.: 426,446

[22] Filed: Oct. 25, 1989

[51] Int. Cl.[5] ..... C06C 5/04

[52] U.S. Cl. ..... 102/275.6; 102/275.1; 102/275.8

[58] Field of Search ..... 102/275.8, 275.1, 275.6, 102/275.4, 200

[56] References Cited

U.S. PATENT DOCUMENTS

| | | | |
|---|---|---|---|
| 548,022 | 10/1895 | Watson | 102/275.1 |
| 1,702,206 | 2/1929 | Fritzsche | 102/275.1 |
| 2,445,032 | 7/1948 | McFarland | 102/275.8 |
| 2,891,475 | 6/1959 | Dolan et al. | 102/275.8 |
| 2,982,210 | 5/1961 | Andrew et al. | 102/275.8 |
| 3,296,968 | 1/1967 | Shulman et al. | 102/275.8 |
| 3,590,739 | 7/1971 | Persson | 102/275.8 |
| 4,083,305 | 4/1978 | Garrison et al. | 102/275.8 |
| 4,328,753 | 5/1982 | Kristenson et al. | 102/275.8 |
| 4,488,486 | 1/1984 | Betts | 102/275.1 |
| 4,493,261 | 1/1985 | Simon et al. | 102/275.8 |

*Primary Examiner*—David H. Brown

*Attorney, Agent, or Firm*—William R. Hinds

[57] ABSTRACT

The cord system comprises a relatively thin detonating cord which can be readily bent round small diameter corners and is of low weight per unit length, the cord comprising an outer relatively thick tube and an inner relatively thin tube of a different material of greater density than the outer tube, the secondary explosive for detonation being within the inner tube. When ignited the cord remains thereby protecting any apparatus positioned close to it from damage by the explosion contained within the cord.

10 Claims, 2 Drawing Sheets

NON-DISRUPTIVE DETONATING CORD

The present invention relates to non-disruptive detonating cords and more particularly to cords which once ignited have sufficient output to ignite a secondary explosive such as RDX, HMX, RHA or PETN.

Detonating cords are used in many applications both civil and military, particularly in emergency situations wherein a remote charge of secondary explosive requires to be set off extremely rapidly to, for example relieve pressure in a pipe line etc.

Known detonating cords are bulky and difficult to bend round corners thereby being difficult to place in position. It is an object of the present invention to provide a detonating cord which has a relatively small diameter and may therefore be readily bent. An additional and important advantage is that since the diameter is reduced, the weight per unit length of the cord is substantially reduced.

According to the present invention there is provided a non-disruptive detonating cord for detonation of a remote secondary charge, the cord comprising an outer relatively thick walled solid metal tube of a first metal, an inner relatively thin walled metal tube of a second metal abutting the inner surface of the outer tube, the inner tube being filled with a secondary explosive, in which the second metal is of greater density than the first metal, in which the ratio of the thicknesses of the outer and inner metal tubes is greater than 5 to 1 and in which the thickness ratio of the outer and inner tubes in combination with the difference in density between the inner and outer tubes is such that the cord is non-disruptive and retains its integrity on functioning when the secondary explosive is ignited.

Preferably the second material is selected from one of the metals lead, gold or depleted uranium or an alloy thereof to provide a dense inner tube. Preferably the first material is selected from one of the metals aluminium, magnesium or copper or an alloy thereof to provide a lighter outer tube.

In a particular embodiment the material of the outer tube comprises a laminate concentric structure in which the densities of the layers decreases towards the outside diameter of the tube.

In a preferred embodiment the inner tube is of lead and the outer tube is of aluminium.

Preferably the cord diameter is less than 3 mm and in a particular preferred embodiment is less than 1.5 mm.

Also according to the present invention there is provided, in a detonating cord system comprising a detonating cord, the detonating cord containing a continuous core of secondary explosive, a secondary charge attached to one end of the cord for ignition by the secondary explosive of the cord when ignited, means attached to the opposite end of the cord for igniting the secondary explosive, the improvement characterised in that the cord comprises an outer relatively thick walled solid metal tube of a first metal, an inner relatively thin walled tube of a second metal abutting the inner surface of the outer tube, the inner tube being filled with the secondary explosive, in which the second metal is of greater density than the first metal and in which the thickness of the outer and inner tubes in combination with the difference in density between the inner and outer tubes is such that the cord is non-disruptive and retains its integrity on functioning when the secondary explosive is ignited.

Embodiments of the present invention will now be described, by way of example with reference to the accompanying drawings in which.

Figure 1:
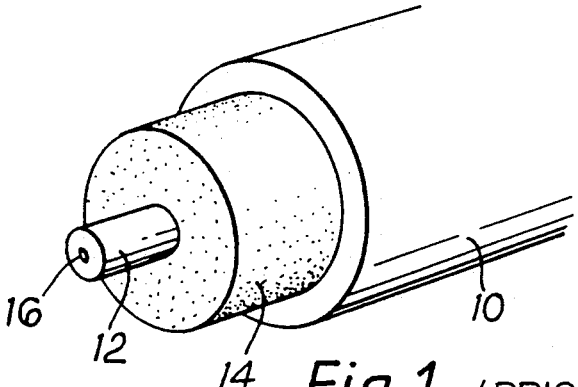
Fig. 1 (PRIOR ART)
FIG. 1 shows a known detonating cord in end perspective.

The known cord of FIG. 1 comprises a stainless steel tube 10 of approximately 6 mm diameter with an inner tube 12 of lead silver or aluminium spaced apart therefrom by a hemp or similar filling 14. A secondary explosive 16 such as PETN fills the inner tube 12. In operation the explosive 16 is ignited by a suitable detonator (not shown) in known manner. The cord may be for example several meters in length and the explosive ignites along this length at a speed of about 6000 to 8000 meters per second. As the explosive ignites, the inner tube 12 melts and gases are produced which produce a shock wave which is partially absorbed by the hump 14. The stainless steel tube 10 resists the gases and the detonation is contained within the tube 10 which contains the gas pressure.

The smallest diameter of such a cord available is 6 mm and to make it smaller is difficult because the requirement to absorb the gas pressure and to ensure maintenance of the detonation action over the entire length of the cord.

At the far end (not shown) the cord is normally inserted directly into a secondary explosive charge and the charge is directly detonated by the cord without any need of a further detonator.

The cord of FIG. 1 is bulky and is therefore difficult to handle and install.

Figure 2:
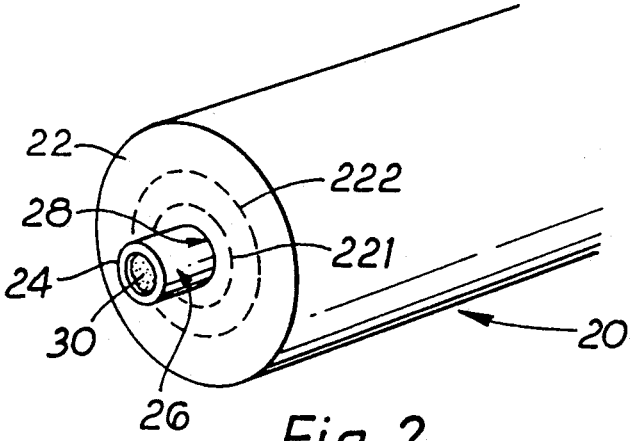
FIG. 2 shows a detonating cord according to the present invention.

With reference now to FIG. 2 the inventive cord 20 comprises an outer tube 22 and an inner tube 24 the outer surface 26 of which substantially abuts the inner surface 28 of the tube 22. The inner tube 24 is filled with secondary explosive 30.

The outer tube 22 is preferably made of a material with a substantially lower density than the inner tube 24 and is also substantially greater in its wall thickness.

The outer wall tube 22 may be laminated as indicated by dotted rings 221–222 etc but preferably each laminate layer is of different material with the density of the inner layers 221 being higher than that of the outer layers 222 but still lower than that of the material of the inner tube 24.

Preferably the wall thickness ratios of the outer to inner tubes will be greater than 5 to 1.

Suitable materials for the inner tube are lead, gold and depleted uranium all being of high density, for the outer tube suitable materials are aluminium, magnesium and copper and alloys or laminates thereof.

Preferably the outside diameter of the cord will be less than 3 mm and in particular practical examples is 1.5 mm and 1.3 mm. A preferred diameter is less than 1.5 mm since this makes the cord extremely flexible in use. The longitudial speed of detonation along the cord is approximately 5000 meters per second.

Figure 3:
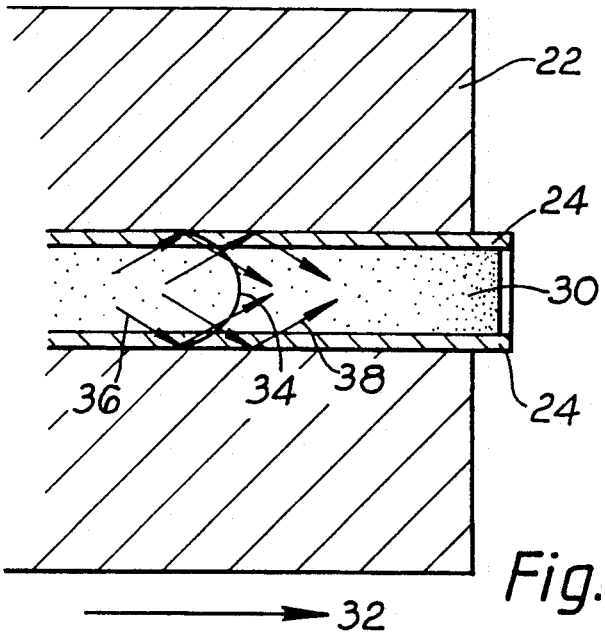
FIG. 3 shows a longitudinal cross section a diagramatic representation serving to explain the operation of the cord of FIG. 2, and FIG. 4 diagrammatically shows the detonating cord attached respectively to an igniter and a secondary charge at its ends.
Figure 4:
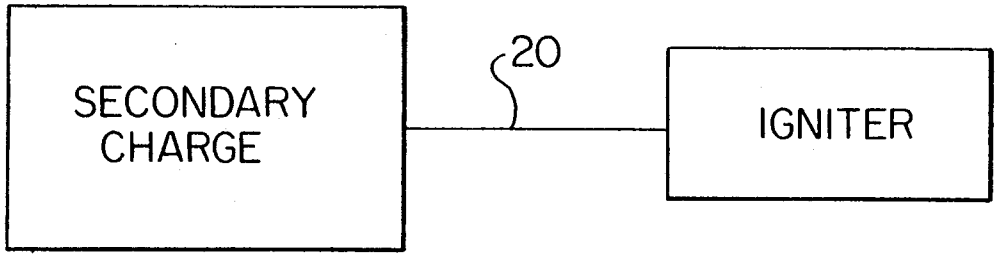

The operation of the cord is explained as far as possible with reference to FIG. 3. It will be appreciated that since the operational speed is 5000 meters per second it is difficult to observe the explosive action especially as this is wholly contained within the outer tube 22.

In longitudinal cross section the cord is shown with detonation commencing at the left hand side. The detonation of the explosive 30 proceeds from left to right in the direction of arrow 32. The explosion creates a shock wave shown at 34 and the heat melts the inner tube 24. Because of the difference in material densities at the outer diameter of tube 24 and inner diameter of tube 22 the shock wave is propogated as shown by arrows 36, 38 "bouncing" back from tube 22 in a direction to continue the advance of the detonation. The wall thickness of the tube 22 is required to be substantial to contain the pressure produced by the explosive gases, which pressure may rise to about 3,000,000 psi. The outer tube 22 is enlarged in diameter by the passage of the shock wave but remains intact.

Because the cord retains its integrity on functioning (non-disruptive) the cord may be placed close to sensitive apparatus which will not be damaged by the ignition of the cord. This is advantageous since in combination with the small diameter and, therefore, great flexibility of the cord this allows the cord to be placed in positions where previous cords could not be so placed.

The amount of explosive used in the narrow cord of 1.5 or 1.3 mm diameter is very small and therefore a large length of cord can be carried in for example a helicopter to remote locations without contravening explosive regulations.

The cord is manufactured by a rolling or drawing process starting with an inner tube filled with explosive, drawing this inner tube down until its diameter is such that it will just fit inside the outer tube, inserting the inner into the outer and then drawing the whole down to a small diameter. If a laminated outer is required then the process is repeated by sliding the combined inner and outer into a further tube etc.

For ease of handling, a plastic outer sheath may be applied for example by heat shrink methods to the outside of the cord.

I claim:

1. A non-disruptive detonating cord for detonation of a remote secondary charge, the cord comprising an outer relatively thick walled solid metal tube of a first metal, an inner relatively thin walled metal tube of a second metal abutting the inner surface of the outer tube, the inner tube being filled with a secondary explosive, in which the second metal is of greater density than the first metal, in which the ratio of the thicknesses of the outer and inner metal tubes is greater than 5 to 1 and in which the thickness ratio of the outer and inner tubes in combination with the difference in density between the inner and outer tubes is such that the cord is non-disruptive and retains its integrity on functioning when the secondary explosive is ignited.

2. A detonating cord as claimed in claim 1 in which the material of the outer tube comprises a laminate concentric structure in which the densities of the layers decrease towards the outside diameter of the tube.

3. A detonating cord as claimed in claim 1 in which the inner tube is of lead and the outer tube of aluminium.

4. A detonating cord as claimed in claim 1 in which the cord diameter is less than 3 mm (0.125 inches).

5. A detonating cord as claimed in claim 1 in which the cord diameter is less than 1.5 mm (0.0625 inches).

6. A detonating cord as claimed in claim 1 in which the second metal is selected from one of the metals lead, gold or depleted uranium or an alloy thereof to provide a dense inner tube.

7. A detonating cord as claimed in claim 6 in which the first metal is selected from one of the metals aluminium, magnesium or copper or an alloy thereof to provide a lighter outer tube.

8. In a detonating cord system comprising a detonating cord, the detonating cord containing a continuous core of secondary explosive, a secondary charge attached to one end of the cord for ignition by the secondary explosive of the cord when ignited, means attached to the opposite end of the cord for igniting the secondary explosive, the improvement characterised in that the cord comprises an outer relatively thick walled solid metal tube of a first metal, an inner relatively thin walled tube of a second metal abutting the inner surface of the outer tube, the inner tube being filled with the secondary explosive, in which the second metal is of greater density than the first metal and in which the thickness of the outer and inner tubes in combination with the difference in density between the inner and outer tubes in such that the cord is non-disruptive and retains its integrity on functioning when the secondary explosive is ignited.

9. A detonating cord for detonation of a remote secondary charge, the cord comprising an outer relatively thick walled solid metal tube of a first metal, an inner relatively thin walled tube of a second metal abutting the inner surface of the outer tube, the inner tube being filled with a secondary explosive, in which the second metal is of greater density than the first metal, in which the ratio of the thickness of the outer and inner tubes is greater than 5 to 1, in which the diameter of the cord is less than 3 mm (0.125 inches), and in which the thickness of the outer and inner tubes in combination with the difference in density between the inner and outer tubes is such that the cord is non-disruptive and retains its integrity on functioning when the secondary explosive is ignited.

10. A detonating cord for detonation of a remote secondary charge, the cord comprising an outer relatively thick walled solid metal tube of a first metal, an inner relatively thin walled tube of a second metal abutting the inner surface of the outer tube, the inner tube being filled with a secondary explosive, in which the second metal is of greater density than the first metal, in which the ratio of the thickness of the outer and inner tubes is greater than 5 to 1, in which the metal of the outer tube comprises a laminate concentric structure in which the densities of the layers decrease toward the outside diameter of the tube, in which the cord diameter is less than 3 mm (0.125 inches), and in which the thickness of the outer and inner tubes in combination with the difference in density between the inner and outer tubes is such that the cord is non-disruptive and retains its integrity on functioning when the secondary explosive is ignited.

* * * * *

UNITED STATES PATENT AND TRADEMARK OFFICE

CERTIFICATE OF CORRECTION

PATENT NO. : 4,991,511

DATED : February 12, 1991

INVENTOR(S) : GEOFFREY M. SIMPSON

It is certified that error appears in the above—identified patent and that said Letters Patent is hereby corrected as shown below:

On the title page of the printed patent, the information page, between the line headings numbered [22] and [51], the following is added:

[30] Foreign Application Priority Data

Nov. 5, 1988 [GB] United Kingdom ..... 8825972

Signed and Sealed this

Thirtieth Day of June, 1992

*Attest:*

DOUGLAS B. COMER

*Attesting Officer*

*Acting Commissioner of Patents and Trademarks*